US007228961B2

(12) United States Patent
Koetter et al.

(10) Patent No.: US 7,228,961 B2
(45) Date of Patent: Jun. 12, 2007

(54) PACKAGED ARTICLE WITH TEAR-AWAY LABEL PORTION

(75) Inventors: Stephen Koetter, Macon, GA (US); Donald A. Stringfield, Macon, GA (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 370 days.

(21) Appl. No.: 10/838,591

(22) Filed: May 4, 2004

(65) Prior Publication Data

US 2005/0247583 A1 Nov. 10, 2005

(51) Int. Cl.
*B65D 85/10* (2006.01)

(52) U.S. Cl. ..... 206/271; 206/459.5

(58) Field of Classification Search ..... 206/242, 206/265, 268, 271, 273, 831, 459.5; 40/312; 229/160.1

See application file for complete search history.

(56) References Cited

U.S. PATENT DOCUMENTS 3,750,317 A 8/1973 Morgan
3,958,744 A 5/1976 Herglotz
4,308,679 A 1/1982 Ray, III et al.
4,324,823 A * 4/1982 Ray, III ..... 206/831
4,551,373 A 11/1985 Conlon
5,035,935 A * 7/1991 Thomas et al. ..... 206/831
5,427,235 A 6/1995 Powell et al.
5,465,837 A 11/1995 Focke
5,806,671 A * 9/1998 Focke et al. ..... 206/268
5,826,785 A * 10/1998 Belvederi et al. ..... 229/160.1
6,047,488 A 4/2000 Tuszkiewicz
6,068,181 A * 5/2000 Cai ..... 206/459.5
6,669,015 B2 * 12/2003 Draghetti et al. ..... 206/271

* cited by examiner

*Primary Examiner*—Luan K. Bui
(74) *Attorney, Agent, or Firm*—Steve A. Witters; Charles I. Sherman; Middleton Reutlinger

(57) ABSTRACT

A multi-ply wrapper for a package includes an inner ply of material having printed indicia at selected portions thereon and an outer ply of material laminated to the inner ply wherein the outer ply is provided with perforated sections aligned to cover the printed indicia. A two-ply wrapper is particularly useful in cigarette packaging for circumscribing a foil wrapped bundle of cigarettes whereby upon peeling away the perforated section of the outer ply, graphics are disposed which include consumer information, advertising, special offers, coupons and the like.

5 Claims, 3 Drawing Sheets

PACKAGED ARTICLE WITH TEAR-AWAY LABEL PORTION

BACKGROUND OF THE INVENTION

The present invention relates to a tear-away label usable with packaged articles and more particularly to a two-ply label for a packaged article wherein an inner ply of the label includes selected portions with printed indicia thereon and the outer ply has tear-away portions covering the printed indicia.

In the packaging of articles for consumers, it is common to place labels circumscribing the articles which provide consumer information, including advertisements, special offers and the like. In the manufacture of soft pack cigarette articles, a bundle of cigarettes are generally wrapped in an aluminum foil type material with a paper label circumscribing the foil. This paper label may include consumer information thereon. Clear plastic, such as a polyfilm, is then used to enclose the label and the bundle of cigarettes.

SUMMARY OF THE INVENTION

It is an object of the present invention to provide a multi-ply label which is usable in the manufacture of packages of articles.

It is another object of the present invention to provide a multi-ply label with a perforated outer ply and a printed inner ply which is used to wrap a foil bundle of cigarettes.

It is a further object of the present invention to provide a cigarette bundle having a two-ply label wherein the outer ply can be peeled away at a perforated section to reveal graphics printed on an inner ply.

More particularly, the present invention is directed to an outer wrap for a package which includes an inner ply of material having printed indicia at selected portions thereon and an outer ply of material laminated to said inner ply wherein the outer ply is provided with perforated sections aligned to cover the printed indicia on the inner ply.

Even more particularly, the present invention is directed to a cigarette package which includes a bundle of cigarettes wrapped by a foil material wherein the foil material is circumscribed by a two-ply wrapper having an inner ply of material with printed indicia at selected portions thereon and an outer ply of material laminated to the inner ply wherein the outer ply is provided with perforated sections aligned to cover the printed indicia. The two-ply wrap is then encased in a clear polyfilm material.

DETAILED DESCRIPTION OF THE PRESENT INVENTION

Figure 2:
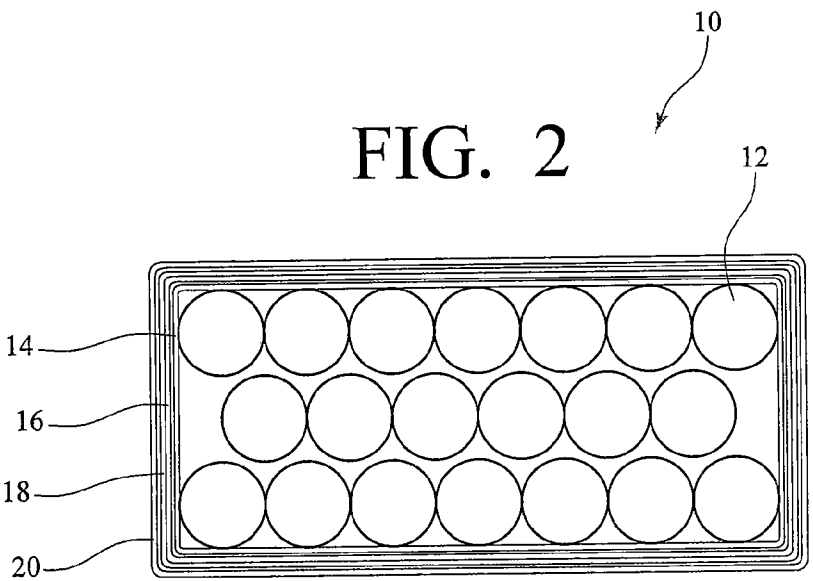
FIG. 2 is a sectional view of the package of FIG. 1 taken along line 2—2.
Figure 1:
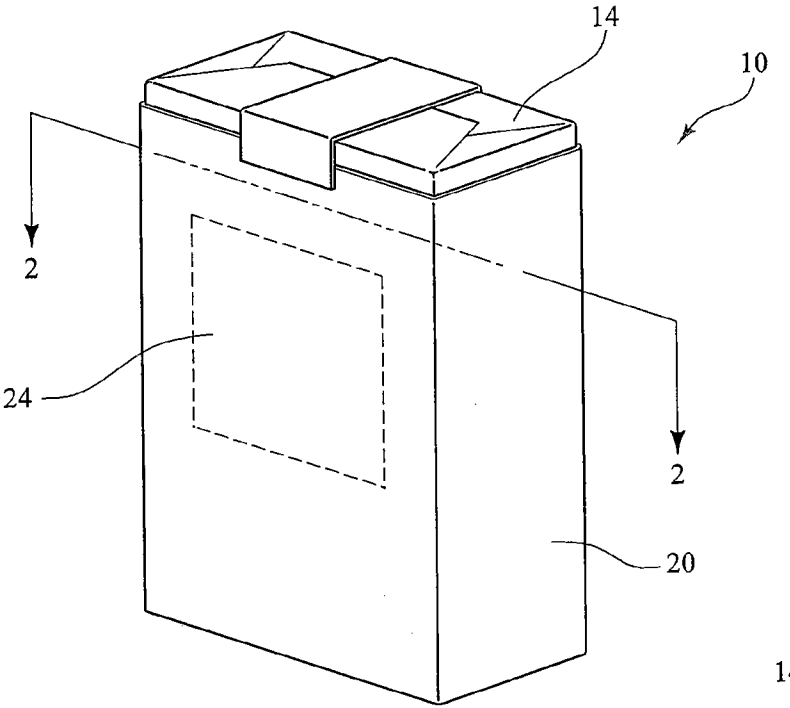
FIG. 1 is a perspective view of a package of the present invention.

As shown in FIGS. 1 and 2, a cigarette package 10 includes a foil wrapper 14 which wraps a plurality of cigarettes 12. Circumscribing the foil wrapper 14 is a two-ply laminated label which includes an inner layer 16 and an outer layer 18. Polyfilm 20, such as a polypropylene, circumscribes the two-ply wrapper and the bundle of cigarettes. The polyfilm 20 is clear or transparent so that any indicia printed upon the outer layer 18 of the label is clearly visible to the consumer.

Figure 3:
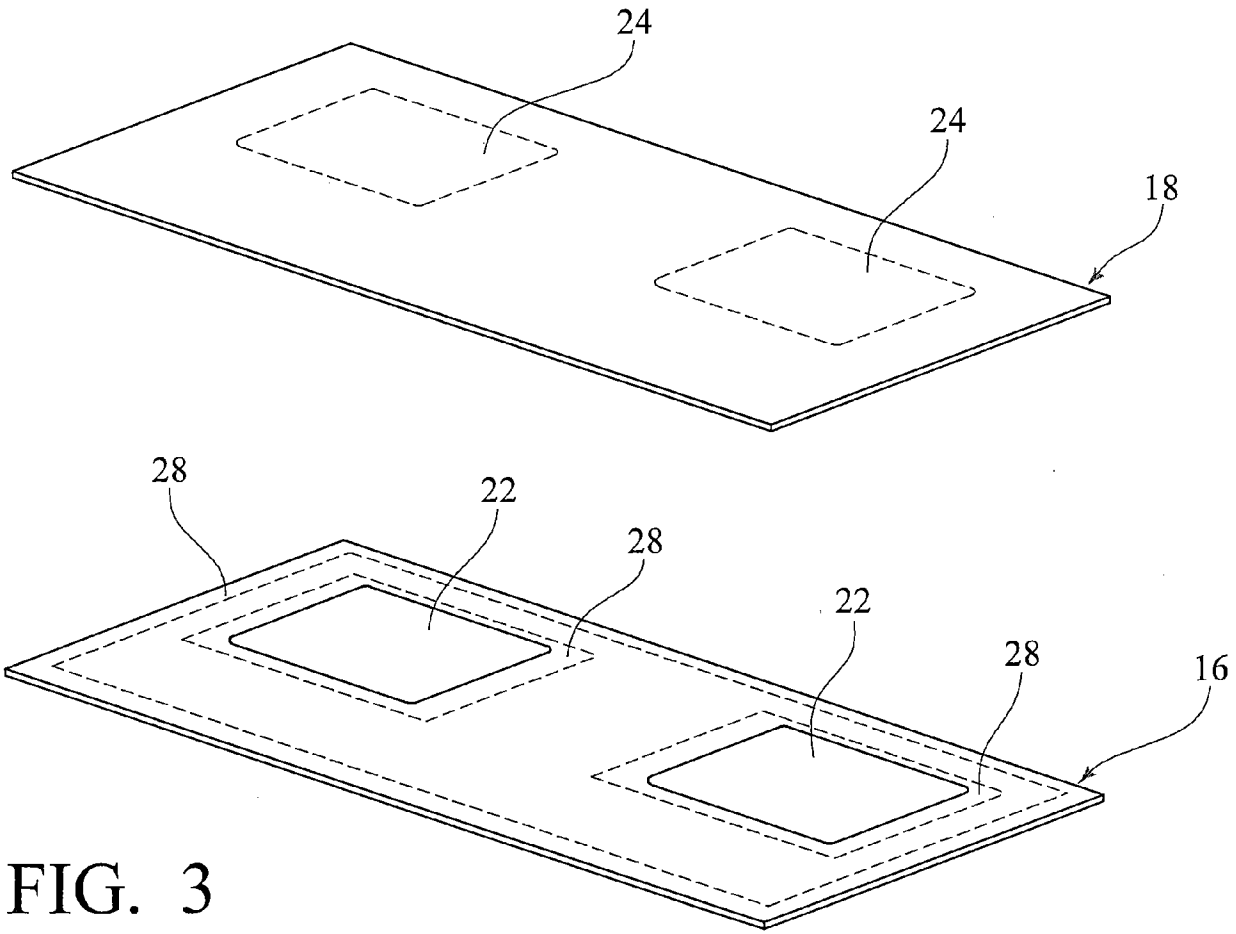
FIG. 3 is an exploded view, in section, of the two-ply label of FIG. 1; and, FIG. 4 is a perspective view of the packaged article of FIG. 1 with the outer polyfilm removed and a portion of an outer ply of a two-ply wrapper exposing printed indicia on an inner ply of the two-ply wrapper.

As shown in FIG. 3, the two-ply wrapper includes an inner layer 16 and the outer layer 18. The inner layer 16 is provided with selected portions 22 thereon for printed indicia which is to be exposed once the package is opened and tear-away section 24 covering the selected portion 22 is peeled away. Adhesive 28 is applied to either the inner side of the outer layer 18 or the outer side of the inner layer 16 in the areas outside the selected portions 22 for the written indicia on the inner portion of the two-ply wrapper. The printed indicia within the portion 22 of inner layer 16 includes promotional information, coupons, and the like.

Figure 4:
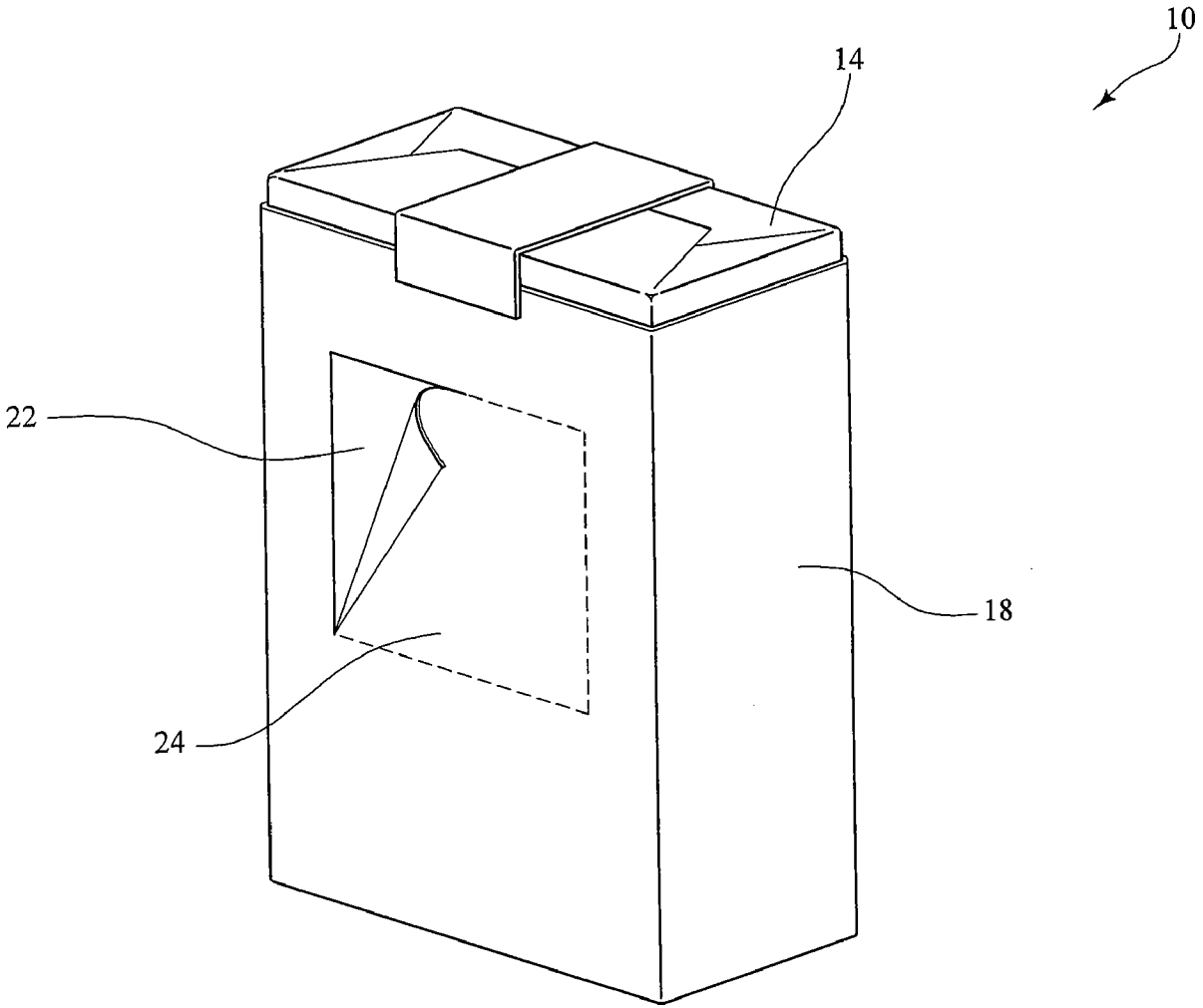

As shown in FIG. 4, a package 10 is shown with the polyfilm 20 being removed and the tear-away section 24 being partially removed to expose the indicia bearing portion 22 on the inner layer.

It will be realized that various changes may be made to the specific embodiment shown and described without departing from the principals and spirit of the present invention.

What is claimed is:

1. A soft pack cigarette package comprising:

a bundle of cigarettes;

an inner foil wrapper completely enclosing said bundle of cigarettes;

a two-ply wrapper, said two-ply wrapper including an inner ply of material circumscribing said enclosed bundle of cigarettes except for an upper end thereof and having printed indicia at selected portions thereon and an outer ply of material adhesively laminated to said inner ply except in an area encompassing said selected portions of printed indicia, said outer ply having tear-away sections aligned to cover said selected portions of printed indicia; and, a transparent film wrapper completely enclosing said two-ply wrapper and the foil wrapped said bundle of cigarettes.

2. The cigarette package of claim 1, said foil being aluminum.

3. The cigarette package of claim 1, said transparent film being a polyfilm.

4. The cigarette package of claim 3, said polyfilm being a polypropylene.

5. The cigarette package of claim 1 having a plurality of said selected portions of printed indicia on said inner ply, each having a said tear-away section of said outer ply aligned therewith.

* * * * *